United States Patent [19]

Anders et al.

[11] Patent Number: 4,998,721

[45] Date of Patent: Mar. 12, 1991

[54] WEIGHTLIFTER'S EXERCISING APPARATUS

[76] Inventors: Douglas H. Anders, 2512 N. 65th St., Omaha, Nebr. 68104; Ronald D. Walton, 5055 S. 161st Cir., Omaha, Nebr. 68135

[21] Appl. No.: 339,655

[22] Filed: Apr. 18, 1989

[51] Int. Cl.[5] ..... A63B 21/06

[52] U.S. Cl. ..... 272/118; 272/123; 272/125; 272/129; 272/144

[58] Field of Search ..... 272/117–138, 272/DIG. 4, DIG. 6, 144; 128/25 R

[56] References Cited

U.S. PATENT DOCUMENTS

| | | | |
|---|---|---|---|
| 3,848,467 | 11/1974 | Flavell | 272/116 X |
| 4,253,662 | 3/1981 | Podolak | 272/123 |
| 4,647,039 | 3/1987 | Noffsinger | 272/125 |
| 4,765,610 | 8/1988 | Sidwell | 272/117 |

FOREIGN PATENT DOCUMENTS

| | | | |
|---|---|---|---|
| 0820854 | 4/1981 | U.S.S.R. | 272/129 |

*Primary Examiner*—Richard J. Apley
*Assistant Examiner*—Joe H. Cheng
*Attorney, Agent, or Firm*—George R. Nimmer

[57] ABSTRACT

For enabling weightlifting athletes to rapidly and efficiently improve concentric-type muscular development, exercising apparatus having two shafts provided with motor-driven barbell-tethered cables is adapted to supplement the athlete's total physiological energy with motor-assist poundage. The motor-assists are of the unidirectional type to rapidly and efficiently improve eccentric-type muscular development. Shafts-mounted braking system protect a weary athlete from the contingency of a rapidly descending barbell.

4 Claims, 1 Drawing Sheet

W = E (+A)

WEIGHTLIFTER'S EXERCISING APPARATUS

BACKGROUND OF THE INVENTION

Athletic proficiency in various sports endeavors (e.g. football, baseball, discus, etc.) is at least partially dependent upon the athlete's state of muscular development. For developing the muscular state of athletes under their tutelage, coaches and other trainers advocate a weightlifting program extending over many months and wherein day-by-day the athlete aspires to lift a barbell of progressively higher weight. In the latter regard, trainers observe that subjecting the athlete to progressively higher barbell loads will not efficiently improve the athlete's muscular state unless he/she is in fact able to actually move the newly increased weight load through concentric or eccentric type muscular contraction. In other words, if an athlete's total physiological energy is dissipated in isometric muscular contraction (i.e. in not actually moving a heavy weight) such isometric exertion will only very slowly improve muscular development.

Accordingly, and with the correlative knowledge that an athlete's progressively improving physiological energy should be actually lifting and/or controllably lowering newly increased weight loads, trainers have endeavored to meticulously chart each athlete's weightlifting progress and to carefully incrementally increase the weight load. Though theoretically effective, such empirical charting and increasing weights program requires intuitive assessment skills not possessed by most trainers.

OBJECTIVE OF THE INVENTION

It is accordingly the general objective of the present invention to provide means for ensuring that an athlete's progressively improving physiological energy will in fact lift and/or controllably lower progressively heavier barbell weights whereby the athlete's rate of muscular development is as rapid as possible. In other words, it being known that unsuccessful attempts to lift a heavy weight will only very slowly enhance an athlete's muscular state, it is within the purview of the general objective to ensure that an athlete's progressively improving physiological energy will now be dissipated in unsuccessful attempts to lift a newly increased weight load. It is an ancillary objective to provide, thru power means, whatever assist might be possibly necessary to enable the athlete's total physiological energy to in fact lift and/or controllably lower newly increased weight loads.

REPRESENTATIVE PRIOR ART

U.S. Pat. No. 3,869,121 (Flavell—Mar. 4, 1975)
U.S. Pat. No. 4,253,662 (Podolak—Mar. 3, 1981)
U.S. Pat. No. 4,746,113 (Kissell—May 24, 1988)

GENERAL OBJECTIVE OF THE INVENTION

With the above general objective in view, and together with other ancillary and specific objectives which will become more apparent as this description proceeds, the weightlifter's exercising apparatus of the present invention generally comprises: a framework that journals a pair of lofty, independently rotatable and laterally extending shafts, and each of said shafts being provided with a drum wrapped with a cable that is suspendably attached to the horizontal bar of a barbell "free-weight"; unidirectional motors for the respective shafts adapted to rotate the cable- wrapped drums thereof; preferably upon direction of an encoder means, a motor control means is adapted to instruct upward force to the cable-suspended barbell whenever the weightlifter's physiological energy is in need of uplift assistance; and each said shaft being provided with brake means to protect an athlete who is too wearied to control barbell movement in the downward direction.

BRIEF DESCRIPTION OF THE DRAWING

In the drawing, wherein like characters refer to like part in the several views, and in which.

DETAILED DESCRIPTION OF THE DRAWING

Figures 1, 2:
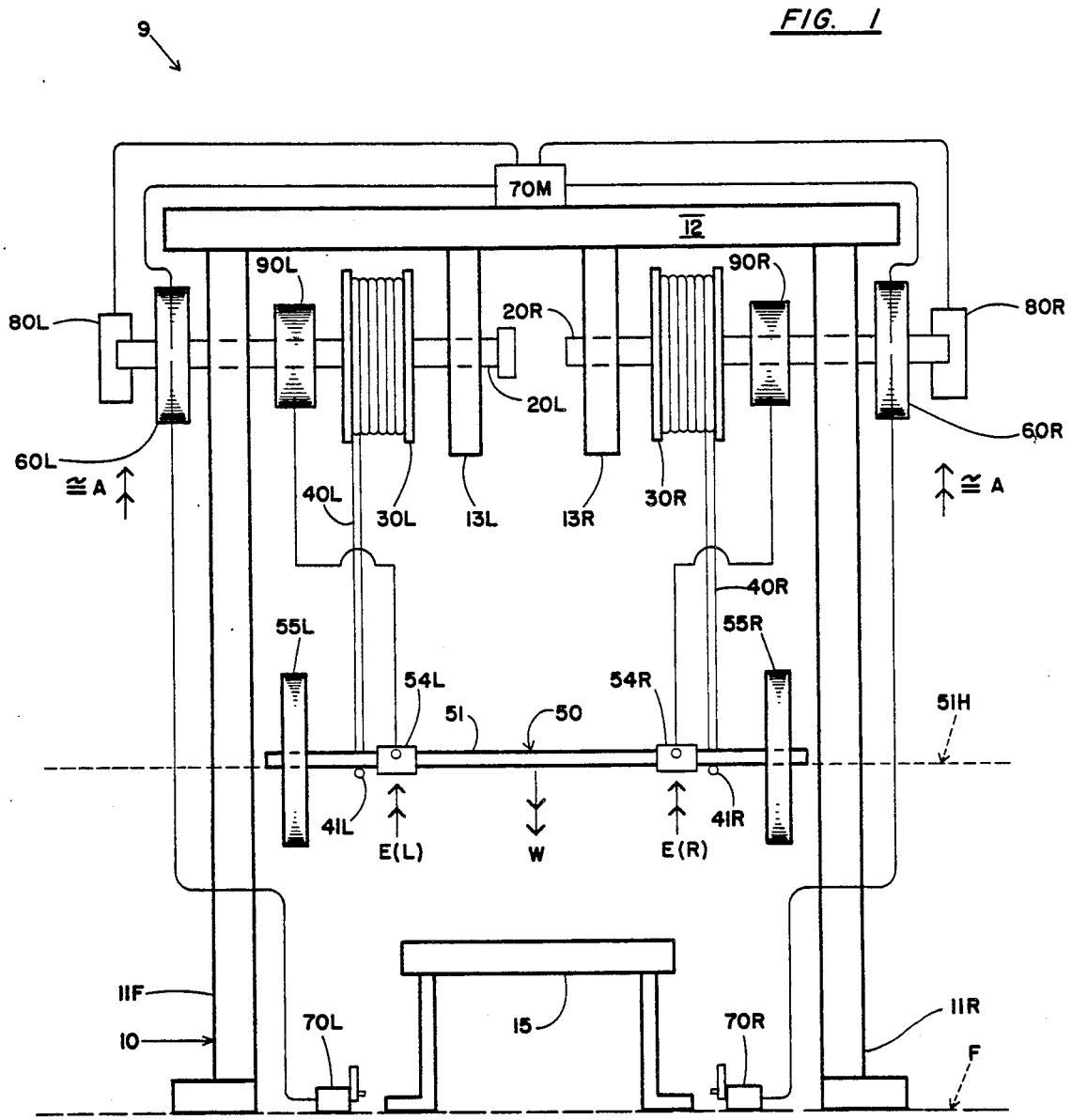
FIG. 1 is a frontal elevational view of a representative embodiment (9) of the weightlifter's exercising apparatus of the present invention.
FIG. 2 schematically depicts a mathematical relationship among: a barbell weight "W"; the total physiological energy (i.e. poundage "E") exertable by the athlete; and the contingency of motorized assist (i.e. poundage "A") for "E" to at least equal "W".

FIG. 1 depicts a basic embodiment 9 of the weightlifter's exercising apparatus of the present invention. FIG. 2 depicts mathamatical relationship among: barbell gravimetric weight "W": the weightlifter's total physiological energy (i.e. poundage "E"); and whatever apparatus assist (i.e. poundage "A") might be necessary for supplementing "E" to substantially equal "W". In conventional barbell situations (50), a horizontal, laterally extending bar (51) provides a minor proporiton of barbell weight "W" and laterally separated add-on discs (55) provide the major proportion of barbell weight "W".

Apparatus embodiment 9 comprises a framework means 10 for extending vertically from environmental horizontal flooring "F", such as vertical columns 11L and 11R, and including a horizontal header 12 loftily overlying flooring "F". Header 12 herein includes downward flanges 13L (left) and 13R (right). Framework 10 journals a pair of independently rotatable, horizontal colineal shafts 20L and 20R. For example, left-shaft 20L is journalled by left-column 11L and left-flange 13L, and right-shaft 20R is journalled by right-column llR and right-flange 13R. The framework might also include a floor-level bench 15 for a supine athlete performing a so-called "bench-press" maneuver to the barbell bar 51.

Left-shaft 20L is provided with a left-drum 30L (wrapped with left-cable 40L) and is also provided with a left-motor 60L adapted to powerably rotate left-shaft 20L. Similarly, right-shaft 20R is provided with a right-drum 30R (wrapeed with right-cable 40R) and is also provided with a right-motor 60R adapted to powerably rotate right-shaft 20R. Motors 60L and 60R are of the variable-speed and adjustable, constant-torque type.

At laterally separated locations, barbell bar 51 is suspended from cable end (41L, 41R), and accordingly, during its vertical reciprocation bar 51 is also free to move multi-directionally along bar horizontal plane 51H in "free-weight" fashion. Constant low-level actuation of motors 60 will ensure suspension-tautness for cables 40.

In the event that an athlete's total physiological energy ("E") is insufficient for verticaly lifting barbell poundage "W", the motors 60 (and working through cables 40) are adapted to provide the assist poundage ("A"). Accordingly, the athlete is enabled to utilize his/her entire physiolocial energy for experiencing concentric-type muscular contractions. In this regard, there are motor control means which might take the form of switches (70L, 70R) which can be empirically actuated by a supine athlete's feet (or by a helping person's hands.

Left-motor 60L and right-motor 60R are unidirectionally employed at left-shaft 20L and at right-shaft 20R respectively, whereby they are unable to decelerate barbell 50 in its downward travel. This imposes the barbell deceleration burden upon the athlete and furnishes him/her the opportunity to experience eccentric-type muscular contractions exceeding his/her physiological ability to experience concentric-type muscular contractions i.e. when the barbell is in upward travel. However, in the event the athlete is too weary to decelerate a downwardly moving barbell, brake means (90L, 90R) can be ecmployed to stop rotation of shafts 20 and descension of cables-tethered barbell 50. The respective brake means (90L, 90R) can be discretionally controlled by the athlete at bar handgrip positions 54. Alternatively, the brake control can be tied-into the encoder means 80L and 80R capability for sensing excessive rotational speed of shafts 20L, 20R a central control 70M, the respective motors 60 at an enhanced constant-torque value can give the necessary assist poundage ("A") for keeping barbell 50 on upward travel. In the event that the cable-tethered barbell bar 51 has been interrupted in its vertical reciprocation, winch means, such as described in U.S. Pat. No. 4,253,662, might be interposed at the juncture of colinear shafts (20L, 20R).

From the foregoing, the construction and operation of the weightlifter's exercising apparatus will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

What is claimed is as follows:

1. Exercising apparatus for enabling a weightlifter athlete to safely utilize the athlete's total physiological energy in vertically reciprocating along a range of vertical height a barbell that gravimetrically surpasses the athlete's total physiological energy, said barbell conventionally comprising a horizontal laterally extending elongate bar as a minor proportion of the barbell gravimetric weight and laterally separated discs as the major proportion of the barbell gravimetric weight, said enabling exercising apparatus comprising:

(A) a framework means including columns extending vertically upwardly from environmental horizontal flooring and also including a horizontal header portion attached to said columns and loftily overlying said flooring;

(B) nearer to said header than to said flooring and journalled by said framework means, a pair of independently rotatable laterally extending horizontal shafts including a left-shaft and a right-shaft, said left-shaft being provided with a left-drum wrapped with a left-cable and said right-shaft being provided with a right-drum wrapped with a right-cable, said respective cables and below said rotatable shafts being attached to laterally separated locations of and suspending the vertically reciprocatable barbell bar portion whereby said vertically reciprocatable barbell is movable multi-directionally in free-weight fashion along the horizontal plane of the barbell bar;

(C) a left-motor adapted to powerably rotate said left-shaft and left-drum, and a right-motor adapted to powerably rotate said right-shaft and right-drum;

(D) motor control means for independently actuating the respective motors and thereby apply upward force to the barbell horizontal bar through attachment cables, whereby the athlete's total physiological energy, and supplementally assistable with said respective motors, will be sufficient to vertically lift the barbell; and (E) said left-shaft being provided with a brake means and said right-shaft being provided with another brake means, whereby said separate brake means are adapted to control rotation of the left-drum and right-drum, respectively, to control barbell movement in the downward direction.

2. the apparatus of claim 1 wherein the brake means is actuatably connected to manually graspable portions of the barbell bar portion.

3. The exercising apparatus of claim 1 wherein said left-motor and said right-motor are of the constant-torque variable-velocity type and employed unidirectionally at said left-shaft and at said right-shaft, respectively, whereby said left-motor and right-motor are unable to decelerate the barbell in the downward direction and thereby can furnish the athlete opportunity to experience eccentric-type muscular contractions that exceed the athlete's physiological ability to experience concentric-type muscular contractions in the barbell upward direction.

4. The exercising apparatus of claim 1 wherein the framework means further includes a floor-level bench for supinely supporting the athlete and wherein said motor control means for independently actuating a supine left-motor and the right-motor is located adjacent said bench for discretionary manipulation by a supine athlete.

* * * * *